US007008191B2

(12) United States Patent
Billington

(10) Patent No.: US 7,008,191 B2
(45) Date of Patent: Mar. 7, 2006

(54) COMPRESSOR WHEEL ASSEMBLY

(75) Inventor: Anthony Billington, Thurstonland (GB)

(73) Assignee: Holset Engineering Company, Limited, (GB)

( * ) Notice: Subject to any disclaimer, the term of this patent is extended or adjusted under 35 U.S.C. 154(b) by 98 days.

(21) Appl. No.: 10/691,388

(22) Filed: Oct. 22, 2003

(65) Prior Publication Data

US 2004/0131469 A1 Jul. 8, 2004

(30) Foreign Application Priority Data

Oct. 24, 2002 (GB) ..... 0224721

(51) Int. Cl.
*F04D 29/26* (2006.01)

(52) U.S. Cl. ..... 416/204 A; 416/244 A

(58) Field of Classification Search ..... 416/204 A, 416/204 R, 244 A
See application file for complete search history.

(56) References Cited

U.S. PATENT DOCUMENTS 2,577,134 A * 12/1951 Land ..... 416/244 R
3,321,221 A * 5/1967 Harris et al. ..... 403/241
3,612,719 A 10/1971 Nomura
4,125,344 A 11/1978 Tiefenbacher
4,183,719 A * 1/1980 Bozung ..... 416/244 A
4,257,744 A 3/1981 Watson
4,353,685 A * 10/1982 Osborn et al. ..... 416/244 A
4,417,855 A * 11/1983 Jepsen ..... 416/244 A
4,705,463 A 11/1987 Joco
5,193,989 A 3/1993 Fleury et al.
2004/0115071 A1 6/2004 Billington
2004/0126231 A1 7/2004 Billington
2004/0126251 A1 7/2004 Billington

FOREIGN PATENT DOCUMENTS

| | | |
|---|---|---|
| GB | 1079580 | 8/1967 |
| GB | 2030269 | 4/1980 |
| JP | 58098629 | 6/1983 |

* cited by examiner

*Primary Examiner*—Edward K. Look
*Assistant Examiner*—Igor Kershteyn
(74) *Attorney, Agent, or Firm*—Krieg DeVault LLP

(57) ABSTRACT

A compressor wheel assembly comprises a compressor wheel (7) mounted to a rotating shaft (8), which extends through a bore provided along the rotational axis of the wheel (7). The wheel (7) is keyed to the shaft (8) such that rotation of the shaft (8) drives rotation of the wheel through the keying engagement.

10 Claims, 2 Drawing Sheets

COMPRESSOR WHEEL ASSEMBLY

The present application claims priority to British Patent Application No. 0224721.1 filed Oct. 24, 2002, which is incorporated herein by reference.

This invention relates to the assembly of a compressor wheel to a rotating shaft. In particular, the invention relates to the compressor wheel assembly of a turbocharger.

Turbochargers are well known devices for supplying air to the intake of an internal combustion engine at pressures above atmospheric (boost pressures). A conventional turbocharger essentially comprises an exhaust gas driven turbine wheel mounted on a rotatable shaft within a turbine housing. Rotation of the turbine wheel rotates a compressor wheel mounted on the other end of the shaft within a compressor housing. The compressor wheel delivers compressed air to the intake manifold of the engine, thereby increasing engine power. The shaft is supported on journal and thrust bearings located within a central bearing housing connected between the turbine and compressor wheel housings.

A conventional compressor wheel comprises an array of blades extending from a central hub provided with a bore for receiving one end of the turbocharger shaft. The compressor wheel is secured to the shaft by a nut which threads onto the end of the shaft where it extends through the wheel bore, and bears against the nose end of the wheel to clamp the wheel against a shaft shoulder (or other radially extending abutment that rotates with the shaft). It is important that the clamping force is sufficiently great to prevent slippage of the wheel on the shaft which could throw the wheel out of balance. An unbalanced wheel will at the very least experience increased vibration, which could shorten the working life of the wheel, and at worst could suffer catastrophic failure.

Modern demands on turbocharger performance require increased airflow from a turbocharger of a given size, leading to increased rotational speeds, for instance in excess of 100,000 rpm. To accommodate such high rotational speeds the turbocharger bearings, and thus the turbocharger shaft diameter, must be minimized. However, the use of a relatively small diameter shaft is problematical with the conventional compressor wheel mounting assembly because the shaft must be able to withstand the high clamping force required to prevent slippage of the wheel. Thus, the strength of the shaft, i.e. the clamping load it can withstand, may limit the mass of compressor wheel that may be mounted to the shaft.

The above problem is exacerbated as continued turbocharger development requires the use of higher performance materials such as titanium which has a greater density than the aluminium alloys conventionally used. The increased inertia of such materials increases the likelihood of compressor wheel slippage, particularly as the compressor wheel rapidly accelerates during transient operating conditions. The clamping force required from a conventional compressor wheel mounting assembly may well exceed that which the shaft can withstand.

One possible way of avoiding the above problem is to use a so-called 'bore-less' compressor wheel such as disclosed in U.S. Pat. No. 4,705,463. With this compressor wheel assembly only a relatively short threaded bore is provided in the compressor wheel to receive the threaded end of a shortened turbocharger shaft. However, such assemblies can also experience balancing problems as the threaded connection between the compressor wheel and the shaft, and the clearance inherent in such a connection, may make it difficult to maintain the required degree of concentricity.

It is an object of the present invention to obviate or mitigate the above problems.

According to the present invention there is provided a compressor wheel assembly comprising a compressor wheel mounted to a rotating shaft, wherein the shaft extends through a bore provided along the rotational axis of the wheel, and the wheel is keyed to the shaft such that rotation of the shaft drives rotation of the wheel through the keying engagement.

Thus, with the present invention the driving force for the compressor wheel is provided by a positive interlocking engagement between the shaft and the wheel. The wheel is preferably retained on the shaft by a nut threaded onto one end of the shaft in the conventional way. However, with the present invention the clamping force provided by the nut is only required to prevent axial movement of the wheel along the shaft. However, if desirable the clamping force could be sufficient to assist the keying engagement ensuring the driving load.

The wheel may be directly or indirectly keyed to the shaft.

Preferably the wheel is indirectly keyed to the shaft via a keying member which interengages keying formations provided on the wheel and the shaft. A preferred form of keying member is a drive washer having an inner aperture to receive said shaft and which is disposed around said shaft between the nut and the wheel, the drive washer having inner and outer keying formations which engage the shaft and wheel keying formations respectively.

Other preferred features of the invention will become apparent from the description below.

Specific embodiments of the present invention will now be described, by way of example only, with reference to the accompanying drawings, in which.

Figure 1:
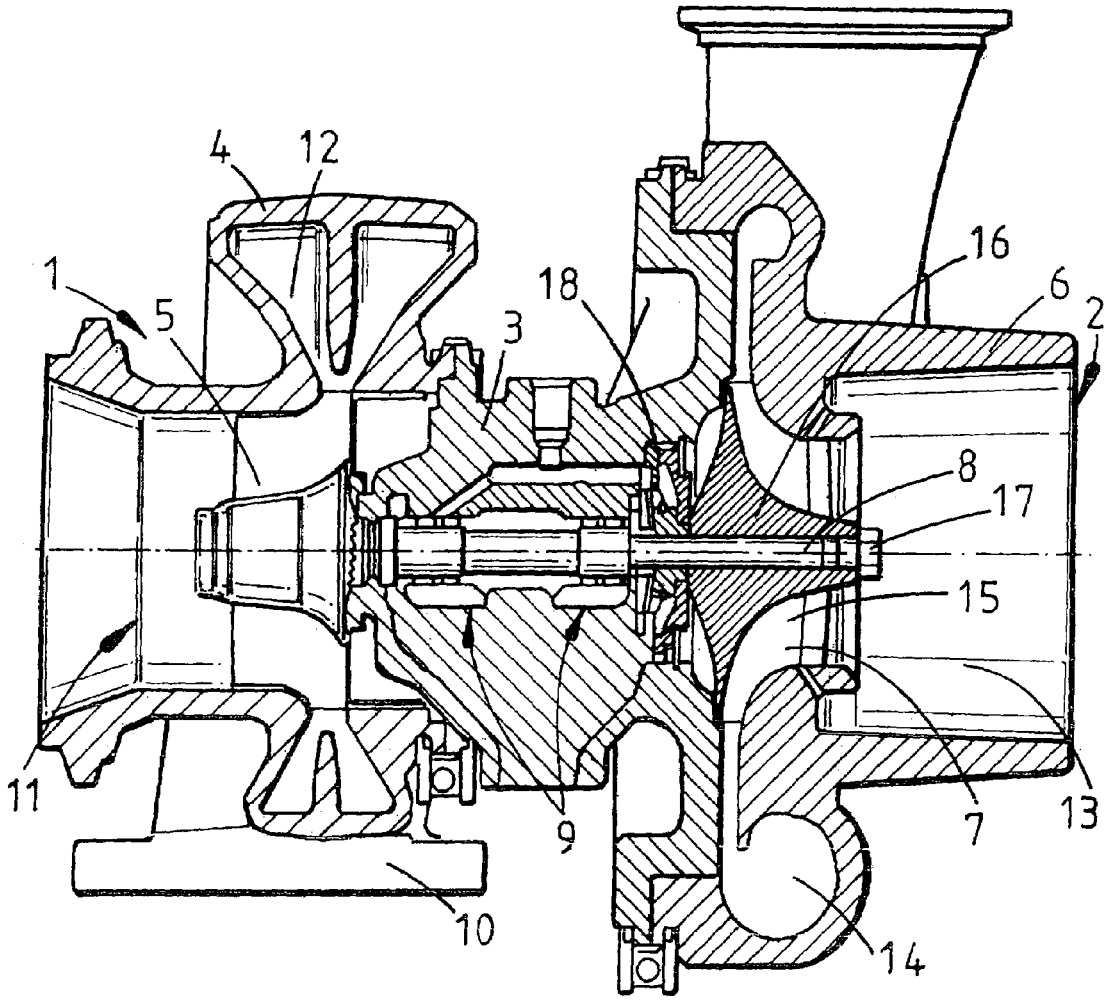
FIG. 1 is an axial cross-section through a conventional turbocharger illustrating the major components of a turbocharger and a conventional compressor wheel assembly.

Referring first to FIG. 1, this illustrates the basic components of a conventional centripetal type turbocharger. The turbocharger comprises a turbine 1 joined to a compressor 2 via a central bearing housing 3. The turbine 1 comprises a turbine housing 4 which houses a turbine wheel 5. Similarly, the compressor 2 comprises a compressor housing 6 which houses a compressor wheel 7. The turbine wheel 5 and compressor wheel 7 are mounted on opposite ends of a common shaft 8 which is supported on bearing assemblies 9 within the bearing housing 3.

The turbine housing 4 is provided with an exhaust gas inlet 10 and an exhaust gas outlet 11. The inlet 10 directs incoming exhaust gas to an annular inlet chamber 12 surrounding the turbine wheel 5. The exhaust gas flows through the turbine and into the outlet 11 via a circular outlet opening which is co-axial with the turbine wheel 5. Rotation of the turbine wheel 5 rotates the compressor wheel 7 which draws in air through axial inlet 13 and delivers compressed air to the engine intake via an annular outlet volute 14.

Referring in more detail to the compressor wheel assembly, the compressor wheel comprises a plurality of blades 15 extending from a central hub 16 which is provided with a through bore to receive one end of the shaft 8. The shaft 8 extends slightly from the nose of the compressor wheel 7 and is threaded to receive a nut 17 which bears against the compressor wheel nose to clamp the compressor wheel 7 against a thrust bearing and oil seal assembly 18. Details of the thrust bearing/oil seal assembly may vary and are not important to understanding of the compressor wheel mounting arrangement. Essentially, the compressor wheel 7 is prevented from slipping on the shaft 8 by the clamping force applied by the nut 17.

Problems associated with the conventional compressor wheel assembly described above are discussed in the introduction to this specification.

Figure 2:
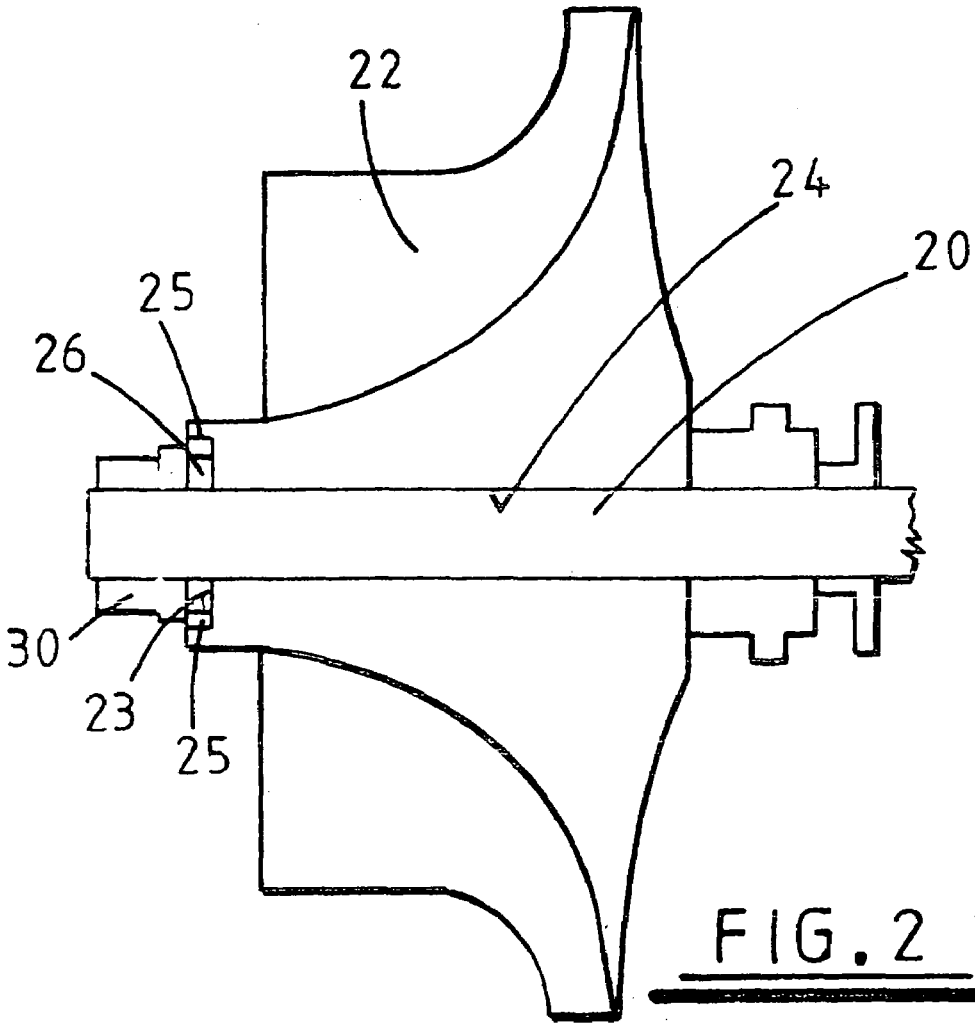
FIG. 2 is a cross-section through a compressor wheel assembly in accordance with the present invention.
Figure 3:
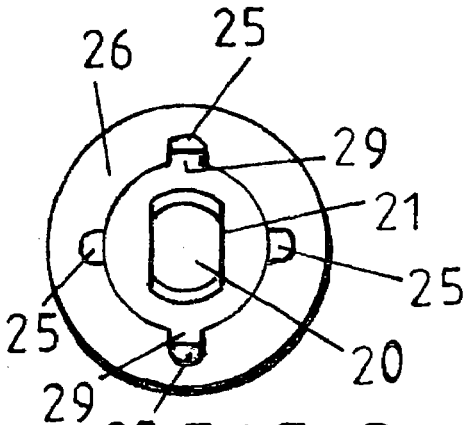
FIG. 3 is an end view of the nose portion of the compressor wheel assembly of FIG. 2, with fixing nut and washer removed.

FIGS. 2 and 3 illustrate one example of a compressor wheel assembly in accordance with the present invention. The turbocharger shaft 20 is modified by the provision of two opposing flats 21 provided at the threaded end of the shaft 20. The flats 21 may for instance simply be machined into the end of the shaft 20. The nose portion of the compressor wheel 22 is countersunk to provide a recess 23 of larger diameter than the compressor wheel through bore 24 which receives the shaft 20. Four circumferentially equi-spaced slots or recesses 25 are provided in the nose of the compressor wheel 22 extending radially from the countersunk recess 23.

Figure 4:
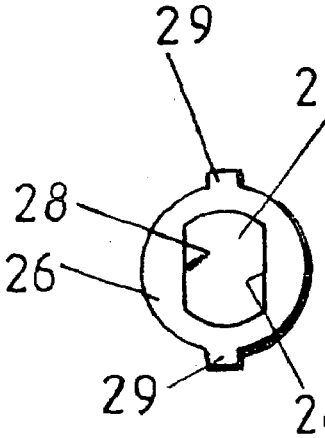
FIG. 4 is a plan view of a drive washer from the compressor wheel assembly of FIGS. 2 and 3.

A drive washer 26 (shown in isolation FIG. 4), sits around the shaft 20 within the recess 23. The drive washer 26 has a non-circular central aperture 27 provided with opposing flats 28 which engage the flats 21 provided on the shaft 20. Two diametrically opposed lugs 29 extend radially from the circular outer circumference of the drive washer 26 and engage within diametrically opposed slots 25 provided in the recessed nose portion of the compressor wheel 22. The drive washer 26 is held in place by a flanged nut 30 threaded onto the end of the shaft 20.

The compressor wheel 22 is thus keyed to the shaft 20 via the drive washer 26 which acts as a keying member. The shaft 20 and wheel 22 are thus interlocked and must rotate together. It is not therefore possible for the wheel 22 to slip as the shaft 20 rotates. This removes (or at least reduces) the reliance on the clamping force provided by the nut 29, which need only be sufficient to maintain the drive washer 26 in place and prevent axial movement of the wheel 22 along the shaft 20. However, a clamping force provided by the nut 29 may be relied upon to supplement the keying action of the drive washer 26 and share the drive load.

Providing the keying interconnection between the shaft 20 and wheel 22 at the nose portion of the wheel 22, as opposed for instance to the inboard side of the wheel 22, greatly reduces the likelihood of stress failure since the nose portion of the wheel 22 is cooler than the inboard portion of the wheel.

It will be appreciated that many modifications may be made to the detail of the embodiment of the invention described above. For instance, the number of flats provided on the end of the shaft may vary i.e. there may be only one or more than two. Similarly, the number of lugs provided on the drive washer and/or slots provided in the nose of the compressor wheel may be varied. It is preferable to have a plurality of at least one or the other to provide a number of alternative angular mounting positions for the compressor wheel to aid in balancing of the compressor wheel assembly. It is also preferable to have a plurality of keying engagements between the compressor wheel and drive washer/turbocharger shaft to distribute the drive load.

The keying formations provided on the drive washer, and on the shaft and wheel may take a different configuration from those illustrated. For instance, the compressor wheel could be provided with radially inward projections and the drive washer could be provided with recesses in its external surface to receive those projections. Alternatively the outer circumference of the drive washer could be provided with flats to engage appropriate formation (such as flat portions) defined within the compressor wheel bore. Similarly, other forms of keying engagement may be provided between the drive washer and the shaft, such as projections provided on the drive washer and recesses provided on the shaft. Other possible alternatives will be readily apparent to the appropriately skilled person.

It will also be appreciated that a different form of keying member may be used in place of the drive washer 26. For instance, a plurality of keying members may be provided to interengage between respective formations provided on the shaft and compressor wheel. For instance, both the shaft and compressor wheel could be provided with slots or the like which register with one another, respective keying members extending between the aligned slots/apertures to prevent them rotating out of alignment. However, such arrangements are likely to be more complex in construction and assembly than the advantageously simple drive washer form of keying member.

It will also be appreciated that the invention can be implemented by providing direct keying between the compressor wheel and turbocharger shaft without the provision of a separate keying member. For instance, the internal bore of the wheel, and the shaft, may be provided with directly interengaging keying formations. For example, the nose portion of the wheel may be provided with protuberances which extend radially inwards and engage with flats, or recesses, machined into the end of the shaft. Such arrangements may be more applicable to compressor wheels which have a cast central bore rather than compressor wheels in which the bore is drilled.

It will be appreciated that the present invention is not limited in application to any particular form of compressor wheel, or inboard assembly of bearings etc. Similarly, the present invention is not limited in application to turbocharger compressor wheels but can be applied to compressor wheels in other applications, including, but not limited to, other forms of internal combustion engine supercharger (such as a belt driven compressor wheel).

Other possible modifications and applications of the present invention will be readily apparent to the appropriately skilled person.

What is claimed is:

1. A compressor wheel assembly comprising:

a compressor wheel mounted to a rotating shaft, said shaft extends through a bore provided along the rotational axis of the wheel, said shaft and wheel including keying formations;

a nut which threads on one end of the shaft and bears directly or indirectly against a nose portion of the wheel to clamp the wheel against an abutment and prevent axial movement of the wheel alone the shaft;

a drive washer having an inner aperture to receive said shaft and which is disposed around said shaft between the nut and the wheel, the drive washer having inner and outer keying formations which engage the shaft and wheel keying formations respectively; and wherein the wheel keying formations comprise recesses extending radially into the wheel and the outer keying formations of the drive washer comprise radial projections which engage in said recesses, and said wheel is keyed to the shaft such that the rotation of the shaft drives rotation of the wheel through the keying engagement.

2. A compressor wheel assembly according to claim 1, wherein the shaft keying formations comprise one or more flat portions provided in the circumference of the shaft, and the inner keying formations of the drive washer comprise linear portions of the inner aperture.

3. A compressor wheel assembly according to claim 1, wherein said keying formations include a plurality of keying formations on the compressor wheel and/or shaft allowing indexing of the relative angular position of the wheel on the shaft to aid wheel balancing.

4. A compressor wheel assembly according to claim 1, wherein said keying formations enable indexing of the rotational position of the wheel relative to the shaft to aid in wheel balancing.

5. A compressor wheel assembly according to claim 1, wherein the nose portion of the compressor wheel is countersunk to receive said drive washer.

6. A compressor wheel assembly, comprising:

a compressor wheel mounted to a rotating shaft, the shaft extending through a bore provided along the rotational axis of the wheel;

a wheel keying formation provided on the wheel;

a shaft keying formation provided on the shaft;

a drive washer disposed around the shaft, the drive washer including an aperture to receive the shaft and inner and outer keying formations which engage the shaft keying and wheel keying formations respectively;

a nut which threads on one end of the shaft and holds the drive washer in place and prevents axial movement of the wheel along the shaft; and the wheel keying formation comprises recesses extending radially in the wheel and the outer keying formations of the drive washer comprise radial projections which engage said recesses.

7. A compressor wheel assembly according to claim 6, wherein the shaft keying formation comprise one or more flat portions provided in the circumference of the shaft, and the inner keying formations of the drive washer comprise linear portions of the aperture.

8. A compressor wheel assembly according to claim 6, wherein said keying formations allowing indexing of the relative angular position of the wheel on the shaft to aid in wheel balancing.

9. A compressor wheel assembly according to claim 6, wherein the compressor wheel includes a nose portion which is countersunk to receive said drive washer.

10. A compressor wheel assembly according to claim 9, wherein the nut bears indirectly against the nose portion of the wheel to clamp the wheel against an abutment.

* * * * *